US010940062B1

(12) United States Patent
Nash, Sr.

(10) Patent No.: US 10,940,062 B1
(45) Date of Patent: Mar. 9, 2021

(54) ATHLETE TRANSPORTER APPARATUS

(71) Applicant: Franklin Delano Nash, Sr., Silver Spring, MD (US)

(72) Inventor: Franklin Delano Nash, Sr., Silver Spring, MD (US)

( * ) Notice: Subject to any disclaimer, the term of this patent is extended or adjusted under 35 U.S.C. 154(b) by 0 days.

(21) Appl. No.: 16/404,092

(22) Filed: May 6, 2019

(51) Int. Cl.

| | |
|---|---|
| ***A61G 1/00*** | (2006.01) |
| ***A61G 1/017*** | (2006.01) |
| ***A61G 1/048*** | (2006.01) |
| ***A61G 1/04*** | (2006.01) |
| ***A61G 1/02*** | (2006.01) |

(52) U.S. Cl.
CPC ..... *A61G 1/017* (2013.01); *A61G 1/02* (2013.01); *A61G 1/04* (2013.01); *A61G 1/048* (2013.01)

(58) Field of Classification Search
CPC . A61G 1/017; A61G 1/02; A61G 1/04; A61G 1/048
See application file for complete search history.

(56) References Cited

U.S. PATENT DOCUMENTS 3,052,323 A * 9/1962 Hopfeld ..... B62B 1/14 187/232
3,606,302 A * 9/1971 Allard et al. ..... A61G 1/0237 5/618
4,691,397 A * 9/1987 Netzer ..... A61G 7/0506 248/214
5,203,815 A * 4/1993 Miller ..... A01K 97/08 211/149
5,391,141 A * 2/1995 Hamilton ..... A61F 5/03 128/846
5,474,312 A * 12/1995 Starita ..... B62B 3/10 280/47.19
5,542,740 A 8/1996 Chang
(Continued)

FOREIGN PATENT DOCUMENTS

EP 0406178 A2 1/1991

OTHER PUBLICATIONS

Blitzway, Hannibal figurine 2017, downloaded from https://www.slashfilm.com/blitzway-hannibal-lecter-statues/ May 12, 2019.

*Primary Examiner* — Hau V Phan
(74) *Attorney, Agent, or Firm* — Oliver Edwards; Law Office of Oliver Edwards LLC

(57) ABSTRACT

The present invention pertains to a safety wheeled Athlete Transporter System Apparatus Device Medical Equipment, aimed particularly at enabling the safe, easy, quick, practical, efficient and cost effective method for transporting an injured/incapacitated Athlete/individual from a sports playing Field/Court or the like, to the sideline of a gaming area from/for a type of injury, medical evaluation, etc. This invention expedites multiple medical services and also allows less time delay in the/an underway sports game/activity. Additionally, the injured Athlete does not have to hop, skip, etc., off the playing Field/Court, potentially further injuring the already sustained injury. The invention eliminates the injured person's need to put their arms around the necks/shoulders of the team coaches or trainer's neck, to balance themselves to hop, skip, or jump to the sidelines/health tent, etc., for medical assistance/evaluations. Not a stretcher or wheelchair.

19 Claims, 12 Drawing Sheets

(56) References Cited

U.S. PATENT DOCUMENTS 5,626,352 A * 5/1997 Grace ..... B62B 1/12 280/47.29
5,863,055 A * 1/1999 Kasravi ..... B62B 3/027 280/47.19
5,885,047 A * 3/1999 Davis ..... B62B 1/12 280/47.28
6,135,466 A * 10/2000 Irwin ..... B62B 1/12 280/47.19
6,237,925 B1 5/2001 Koenig
6,273,438 B1 8/2001 Prapavat
6,341,791 B1 1/2002 Cannon
6,409,265 B1 6/2002 Koerlin et al.
6,834,402 B2 12/2004 Hanson et al.
6,880,835 B2 * 4/2005 Tornabene ..... E06C 1/393 280/30
7,025,363 B1 4/2006 Leight
7,069,608 B2 7/2006 Failor et al.
7,165,778 B2 1/2007 Kuiken
7,600,765 B2 10/2009 Tsai
7,637,550 B2 12/2009 Menna
8,360,444 B2 1/2013 Colacecchi
8,764,046 B2 7/2014 Baldemor
9,044,369 B2 * 6/2015 Goldish ..... A61G 5/14
9,050,988 B1 6/2015 McLeod
9,321,471 B1 4/2016 Gedeon-Janvier
9,969,411 B2 * 5/2018 Belotti ..... B62B 5/06
2005/0230928 A1 * 10/2005 Raney ..... B62B 1/002 280/19.1
2008/0284120 A1 11/2008 Butler
2014/0138995 A1 * 5/2014 Leib ..... A61G 5/14 297/283.2
2016/0039441 A1 2/2016 Panigot
2018/0354539 A1 * 12/2018 Casey ..... G01L 5/0095

* cited by examiner

ATHLETE TRANSPORTER APPARATUS

BACKGROUND

Technical Field

The present invention is directed to a type of Medical Stretcher, Hand Truck, Cart, Hand Dolly, Wheel Chair, Recline-able Bed, Gurney, etc., or the like. With and due to the increasing on field/court, injuries of Athletes, including but not limited to football on field injuries, thus the present invention purpose was created, Researched and Developed by an athlete for Athletes. When an athlete is injured or render incapacitated during active play, the/an athlete is often unable to leave the playing Field/Court location under their own power. Especially, if the injury is as serious as a level of concussion or a serious painful type of knee, foot, ankle, hip, turf toe, groin injury, etc., or a simple several minutes long Thigh/Calf/Foot etc., cramp from muscle fatigue or from exhaustion leading to dehydration medical complications. According to a NCAA Data Football Injury Report (2004-2009), football injuries from Torso/Pelvis and Lower Limb injuries combined to a 62 percent of football injuries.

Whether the Athlete is injured playing in early community sports or organized High School Scholastic, College, Semi-Pro or on a Professional level in football, baseball, field hockey, soccer, rugby, etc., the Athlete Transporter System Apparatus Rescue Device Medical Equipment, the Patent Pending nKanGaroo™, is a necessary, valuable, appropriate, timely, immediately needed team equipment implement. Its mobility, manageability, maneuverability to timely get and provide medical instruments, assistance, treatments as well as transport the Athlete from "field/court to sideline" safely, efficiently and effectively is of a tremendous asset. It's a Sports Equipment innovation, that's valuable to reducing further, an "injury to the injured's injuries"™ . . . . "Don't injure the injured's injuries!"™

Optionally, it may feature a Medical Box/Bag Platform, multiple type Container Holders, Storage Compartment(s), Helmet Hooks, Medical Implements Hooks, optional apertures for Immobilizing Strips for Arms/Feet/Head/Seat, Platforms rests for the Derriere, Head, Feet, Arms and Hands, Rear Balance Leg Brace for reclining said unit, "P" and "T", etc., type Dual Handle Bar systems for ease of maneuverability and mobility control, said is of known material such as metal or the like for strength as well as for quick/easy cleaning and sterilization of contact areas. The Athlete Transporter System Apparatus Device Medical Equipment, herein referred to as the nKanGaroo™, (ATSADME™), eliminates the need for the injured Athlete/Individual to hop, skip or jump on one leg and or place their arms around the Coaches/Trainers neck to get off the Field/Court or to be arm cradle, to the sideline for medical injury assistance/evaluation. Said is USA Made, Industrial/Commercial Grade and is capable of having a series of optional platform covers/pads.

Background Art

Herein, are stated/described some differences, the present invention has from prior art as well as are exhibited and shown, embodiment, etc., but not limited, to the present invention purposes and obvious advantages over prior art. However, prior art purposes are not as present invention purposes, though present invention is capable of providing services of prior art stated herein.

Related Art Includes:

U. S. Patent #EP0406178A2, for a wheeled stretcher for the easy transfer of patients from bed to stretcher and vice versa, issued, Jan. 2, 1991, to Claudio Corradi, which is to provide easy patient transfer from bed to stretcher;

U.S. Pat. No. 5,542,740A, for a chair and hand truck issued, Aug. 6, 1996, to Chien L. Chang, which is to provide a more convenient and much better chair or hand truck, whereas present invention differs by having arm, head, leg, etc., rest platforms and its embodiments, nor is it for the same purpose as is the present invention;

U.S. Pat. No. 6,237,925, issued May 29, 2001, to Larry K. Koenig, for a hand truck having ground engaging lever for tilting, whereas present invention does not have said type lever for tilting purpose, though tilting capabilities s accomplished in other means, nor is it for purpose of present invention;

U.S. Pat. No. 6,273,438, issued Aug. 14, 2001, to Vuthisit Prapavat, for a hand truck which compromises several essential elements, however unlike present invention it does not consist of head, arm, leg, seat, etc., rest platforms and its embodiments and nor is it for purposes of present invention;

U.S. Pat. No. 6,409,265B1, issued, Jun. 25, 2002, to James M. Koerlin/Karen Hada, for a tilting and reclining wheelchair, whereas present invention is configured in a Dolly/Hand Truck manner with its multiple embodiments;

U.S. Pat. No. 6,341,791, issued Jan. 29, 2002, to Sammie Cannon Sr., for a wheelchair and bicycle combination assembly, whereas present invention does not have any known mechanical bicycle aspects;

U.S. Pat. No. 6,834,402, issued Dec. 28, 2004, to Thomas W. Hanson/Ronald S. Henderson, for a combination bed mover and patient transfer apparatus, whereas present invention is to transport/transfer an individual for a location to another location it is to be understood it is in a totally different circumstances, manner and means;

U.S. Pat. No. 7,025,363, issued Apr. 11, 2006 to Richard Leight, for a Cargo transportation dolly, which is unlike present invention that has a head, arm, leg, seat, etc., rest platforms and its embodiments, nor is present invention limited to or only for cargo;

U.S. Pat. No. 7,069,608 B2, issued Jul. 4, 2006, to Michal D. Fox, for a Multi-purpose patient chair, which is useful in radiographic and fluoroscopic procedures, unlike present invention that has an elongated frame, "P" and "T", etc., handle systems for maneuverability, multiple embodiments, etc.;

U.S. Pat. No. 7,165,778, issued Jan. 23, 2008 to Todd Kuiken, for a standing wheelchair with an actuator for moving an occupant from sitting to standing position, unlike present invention which has different mechanism and purposes;

U. S. Patent Application Pub. #20080284120 A1, dated Nov. 20, 2008, by Steven Butler, for a handtruck, that is unlike present invention that has a head, arm, leg, seat, etc., rest platforms and its embodiments and embodiments;

U.S. Pat. No. 7,600,765 B2, issued Oct. 13, 2009 to Haiming Tsai, for a handtruck, which is unlike present invention that has a head, arm, leg, seat, etc., rest platforms and its embodiments, nor is present invention limited to or only for cargo;

U.S. Pat. No. 7,637,550 B2, for a stretcher and a patient transport system, issued Dec. 29, 2009, to Ezio Menna, is for supporting a patient in a lying position;

U.S. Pat. No. 8,360,444, issued Jan. 29, 2013, to Jay W. Colacecchi, for a monument transport tool and method, which is unlike present invention that has a head, arm, leg, seat, etc., rest platforms and its embodiments, nor is said for purposes as present invention;

U.S. Pat. No. 8,764,046 B2, issued Jul. 1, 2014, to Johathan Baldemor/Le Bui/Peter Espartero, for multi-functional utility carts, which is unlike present invention that has a head, arm, leg, seat rest platforms etc., and its embodiments, nor is said for purposes as present invention;

U.S. Pat. No. 9,050,988, issued Jun. 9, 2015, to Donald B. McLeod, for a collapsible cart, which is unlike present invention that has a head, arm, leg, seat rest platforms, etc., and its embodiments, nor is said for purposes as present invention;

U. S. Patent Application Pub. #20160039441, dated, Feb. 11, 2006, by Joseph E. Panigot (Sunny Fold LLC), for a collapsible utility cart, which is unlike present invention that has a head, arm, leg, seat, etc., rest platforms and its embodiments, nor is present invention limited to or only for known type conventional cargo; and U.S. Pat. No. 9,321,471, issued Apr. 26, 2016 to Maxime Gedeon-Janvier, for an adjustable and collapsible hand truck with a lifting apparatus which is unlike present invention that has a Head, Arms, Leg, Seat, etc., rest platforms with said embodiments and present invention does not have that lifting apparatus.

SUMMARY OF INVENTION

I, an Athlete and the inventor, recognized the inherent on Field/Court ATHLETE injuries and realized the non-existence of the art in the art, thus the lack of an immediate response and appropriate method and means for Athletes to be assisted from the field in a safe, practical, timely, efficiently and effective method so as not to inflict more pain and suffering to them and their injury. All injured in certain manners do not require a known medical stretcher, known wheel-chair (which are not used/usually) on Fields/Courts at all, if ever), a Golf Cart type transporter, an on-field Ambulance, etc., per injury. Thus, either because of the type of injury, the time taken to locate and or bring prior stated to an Athlete's side, it's realized they are not immediately accessible, logical or practical options for various and obvious reasons.

However, the present invention can be instantly and easily deployed per each normal or required Time Out (Team/Official/TV), when and with team Trainers/Assistants/Coaches with major implements organized on board, such as an Oxygen Tank, enclosed Medical supplies, replenishing liquid(s) (such as Electrolyte-water-specific sports drinks), Tape, Scissors, Smelling Salt, etc., and with the capability of the Athlete being safely and gently transported (rolled off), the playing Field/Court. The immediate Human injury need as well as the concept, design, mass economically production capability, etc., lends to the practicality of present invention. It's the perfect method and apparatus device equipment with its embodiments, to transport an injured Athlete (individual) to a/the sideline/Team Medical Tent, etc., for further medical evaluation and assistance. The Athlete Transporter System Apparatus Medical Device, herein referred to as the "nKangaroo"™, is an apparatus equipment device that does not exist in art form for said herein describe purpose(s) and in this design, concept and or manner.

BRIEF DESCRIPTION OF THE DRAWINGS

Referring now to the drawings/illustration and that which has like numerals representing like parts seen.

FIG. 1 also illustrates a "P" Handle/Loop Handle Area (which is the upper section of Main Body Frame (M.B.F.) Center Support part (said part maybe optional on some M.B.F.), (some M.B.F. may not have a center support embodiment thus, a "P" frame type Handle does not exist) and its "T" Handle Rod/Shaft and its Port Housing Support System provides its pivotal motion, its Center Support Embodiments of the Main Body Frame embodiment (is an optional embodiment), its Frame Horizontal Back Support embodiments, its Wheel/Axle/Brace support assembly embodiments, its Tire/Wheel unit assembly and its Main Body Frame standard known Toe embodiment and its Arm Rest Platforms (two of them) and their Port part embodiment assembly that provides movement, the Arm(s) Rest Platform(s) Frontal Hinge embodiment part mechanism unit assembly, where as the Hinged Arm(s) Platform(s) extension part is supported in the pre-determined Seat Base embodiments on the Seat Platform.

FIG. 1 also illustrates Arm(s) Rest Platform(s) Hinged embodiment mechanisms support extension parts unit assembly in a collapsed and non-collapsed/extended manner and its Arm Rest Platform Hinged embodiment mechanism support extension part assembly and their pre-position Base Seat embodiments on the Seat Platform embodiment part and its Under Seat Platform Storage Compartment embodiment part (optional) and examples of its Pass through Rod/Shaft/Axle/Column, Tube embodiment part(s), etc., or the like which the Head Rest is inserted into and its/the Head Rest Ports Base Mounting System embodiment part(s)/which said has apertures and that provides adjustment/attachable-detachable movement of the said embodiment part(s).

FIG. 1 also illustrates an embodiment 20A that is the Pass through Rod/Shaft/Axle/Column, Tube embodiment part, etc., or the like which is to be inserted into the Tow Handle Housing 9 embodiment which provides pivotal movement of the Push/Tow Handle Embodiment 20A part referred to as the "T" Handle which is also the pivotal anchor embodiment for the Rear Recliner 28 embodiment herein and 20B is the Pass through Rod/Shaft/Axle/Column, Tube embodiment part, etc., or the like which is to be inserted into the Arm(s) Platform 15 Rod/Shaft Port Base 5 embodiment part and the Arm(s) Platform Housing 4 provides pivotal movement of the Arm(s) Platform(s) 15 and 20C is the Pass through Rod/Shaft/Axle/Column, Tube embodiment part, etc., or the like which is to be inserted into the Seat Platform Port Base 22 and into the Seat Platform Housing 7 embodiment part and provides pivotal movement of the Seat Platform 21 and 20D is the Pass through Rod/Shaft/Axle/Column, Tube embodiment part, etc., or the like which is to be inserted into the Feet Platform Port Bases 33 and into the Feet Platform Housing 80 embodiment part which provides pivotal movement for the Feet Platform 26, its Main Body Frame Accessories Hooks 27 (their locations vary on the Main Body Frame 92151).

FIG. 1 is an illustration of embodiment part 20A which is a top side angle view (as seen in FIG. 1) of present invention Rod/Shaft/Horizontal Column/Bar 20A or the like for supporting the Main Body Frame 92151 Tow Handle Embodiment 20A and the Rear Recliner Unit 28 (optional) and said is to be used as an axle type embodiment so it becomes the "T" Handle 20A, this is to be passed through the present invention Tow Bar Housing 9 embodiment and the Rear Recliner Ports 34, whereas said 9 embodiment acts as the housing embodiment for the said 20A embodiment, thus providing and allowing present invention "T" Handle and the Rear Recliner Unit 28, to have rotational type movement and be attachable/detachable and have storable capabilities on/from the Main Body Frame 92151 on a known wheel to axle rotation type system and said has apertures on opposite ends for securing it in desired position (Cotter Key/Pins 49, etc.). Other methods/means available but not shown to achieve desired purpose stated herein.

FIG. 1 is an illustration of embodiment part 20B which is a top side angle view (as seen in FIG. 1) of present invention Rod/Shaft/Horizontal Column/Bar 20B or the like for supporting the Main Body Frame 92151 Arm(s) Platform(s) 15/Arm Platform Ports 5 and said is to be used as an axle rotational type embodiment for the Arm(s) Platform(s) and said is to be the passed through the present invention Arm(s) Platform(s) Housing 4 embodiment, whereas said provides allows embodiment 20B to have rotational type movement and be (have) attachable/detachable/storable capabilities on/in/from the Main Body Frame 92151 on a known wheel to axle type system and said has apertures on opposite ends for securing it in desired position (Cotter Key/Pins 49, etc.). Other methods/means available but not shown to achieve desired purpose stated herein.

FIG. 1 is an illustration of embodiment part 20C which is a top side angle view (as seen in FIG. 1) of present invention Main Body Frame 92151 Rod/Shaft/Horizontal Column/Bar 20C or the like for supporting the Seat Platform 21 with its embodiments/Seat Platform Ports 22 and said is to be used as an axle type embodiment so it becomes the Seat Platform 21 embodiments Platform for support and said is to be passed through the present invention Seat Platform Seat Platform Housing 7 embodiment, whereas said 20C embodiment provides and allows present invention Seat Platform 21, to have a rotational type movement and be attachable/detachable and store-able on/from the Main Body Frame 92151 on and said has apertures on/near opposite ends for securing it in desired position (Cotter Key/Pins 49, etc.). Other methods/means available but not shown to achieve desired purpose stated herein.

FIG. 1 is an illustration of embodiment part 20D which is a top side angle view (as seen in FIG. 1) of present invention Rod/Shaft/Horizontal Column/Bar 20D or the like for supporting the Feet Platform 26 on the Main Body Frame 92151 and said is to be used as an axle type embodiment so it becomes the Feet Platform 26 support and said is to be passed through the present invention Feet Platform Housing 80 embodiment, whereas said is for the Feet Platform 26 embodiment, thus providing and allowing present invention Feet Platform 26 to have rotational type movement and be attachable/detachable and be storable on/from the Main Body Frame 92151 on a known wheel to axle type rotational system and said has apertures on/near opposite ends (known type of embodiment) for securing it in desired position (Cotter Key/Pins 49). Other methods/means available but not shown to achieve desired purpose stated herein.

Figure 5A:
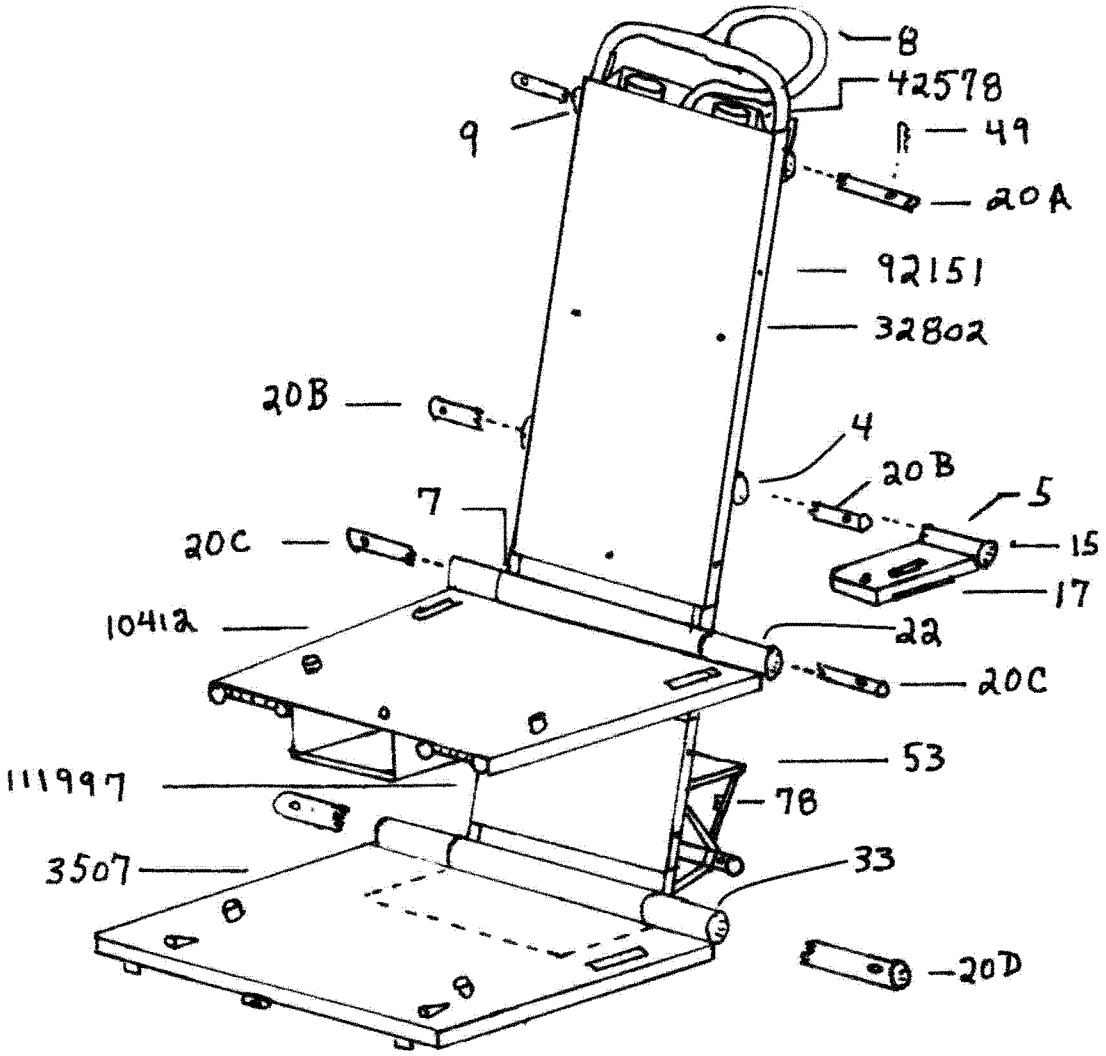
FIG. 5A is a frontal top side angle view of present invention Main Body Frame with section(s) of said Covered Plate aspects with Material such a known Diamond Plate type metal (Painted/unpainted/Powered Coated, etc.), Fabric, Carbon Fiber, combination thereof of a known material(s) and or of some appropriate material according to the end users desire and said such sections/portions can be considered for its Head Rest/Frame, its Front Seat Back section, its Seat/Derriere Platform, its Arm(s) Platform(s), its Liquid/Oxygen Containers, its Under the Seat Section, its Feet Platform, its Leg(s) Extension(s) Platform(s), its Wheel/Tire Guards (optional), its M.B.F. Rear sections/ portions above its/the Wheel/Tire sections/portions as well as other parts sections/portions in Figures Fives inclusive.
Figure 5D:
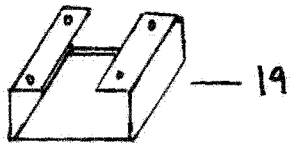

FIG. 5D illustrates an under-seat platform storage compartment component.

FIGS. 5G-5K illustrate various cover plates.

Figure 5G:
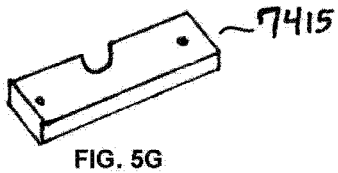
Figure 5H:
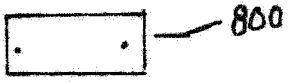
Figure 5I:
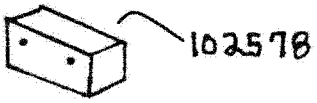
Figure 5J:
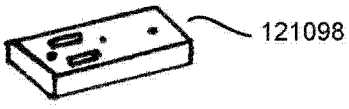
Figure 5K:
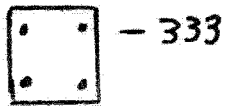
Figure 5L:
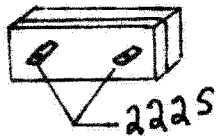

FIG. 5L illustrates a head rest padded embodiment with stud mounting.

Figure 5M:
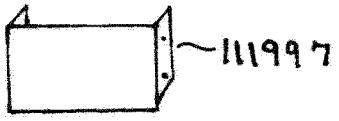

FIG. 5M illustrates a below seat frontal cover plate.

Figure 5N:
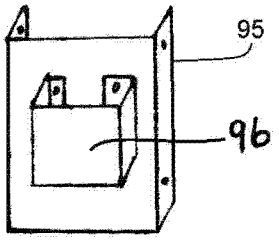

FIG. 5N illustrates an optional rear storage compartment unit.

Figure 5O:
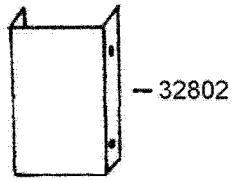

FIG. 5O illustrates an optional rear storage compartment unit.

Figure 5P:
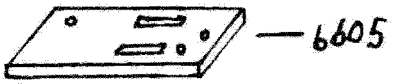

FIG. 5P illustrates a seat to leg(s) extension cover plate.

Figure 5Q:
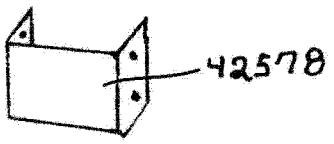

FIG. 5Q illustrates a liquid/oxygen cover plate.

Figure 6:
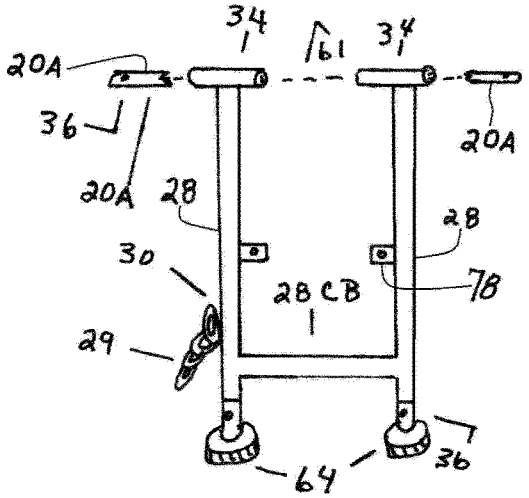

FIG. 6 is a frontal top side angle view of present invention Main Body Frame Rear Recliner Leg(s) Unit embodiment part(s) with its Rear Recliner Legs Unit Cross Bar 28CB support embodiment parts, a view of a cutaway type of known Chain 29 for the Rear Recliner Leg(s) unit embodiment to have limited travel distance (from the M.B.F. when attached and pivoted) or restraint purposes when used with a hook/latch embodiment or the like for said purpose(s)/(is optional) and seen is its Rear Recliner Leg(s) unit embodiment and its Apertures for its interchangeable Leg Ends (shown is the Flat End embodiment 64) optional embodiments, its Loop embodiment and a cut away view of its Pass Through Rod/Shaft/Axle/Column, Tube 20A (cutaway section) embodiment, etc., with its Aperture 36 or the like.

Figure 7:
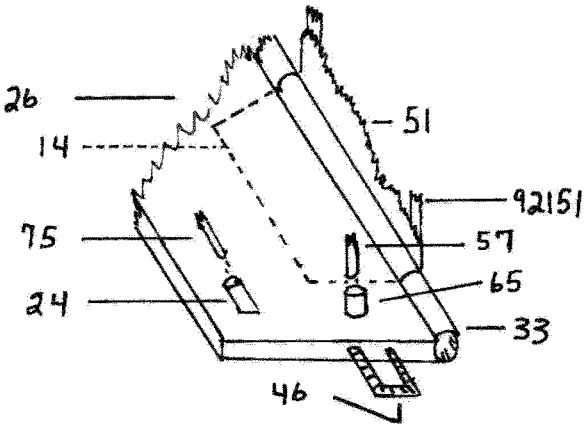

FIG. 7 is a frontal top right side cutaway angle view of present invention Main Mechanism Extension End which is to be placed in/on the Seat Platform Hinged Mechanism Extension Pre-Position Base Seat/Resting Embodiment on the Feet Platform, also seen is a cutaway view of the Leg(s) Extension Platform Hinged Mechanism Extension Extended section/portion Embodiment which is to be placed in/on the Leg Extension Hinged Pre-Position Base Seat/Resting Embodiment located on the Feet Platform, its Feet Platform Handle type (an optional type).

Figure 8:
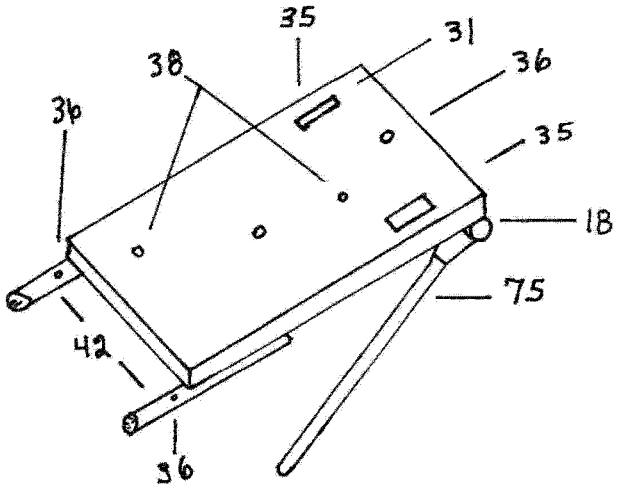

FIG. 8 is a rear top side angle view of present invention Main Body Frame 92151 Seat to Leg Extension Platform with its Apertures for Immobilization/Stabilization Strips, its Storage Aperture, its Duel Rod/Shaft/Tube, etc., or the like that are to be inserted into its corresponding Under Seat Duel Rod/Shaft/Tube, etc. Receptacles or the like in a known male/female typed connection, its Apertures for its/the Cover Plate(s) for the Leg(s) Extension Platform(s), its Leg Extension Platform(s) Frontal Hinged Mechanism Embodiment, its Leg Extension Platform Support Section/Portion Embodiment(s).

Figure 9:
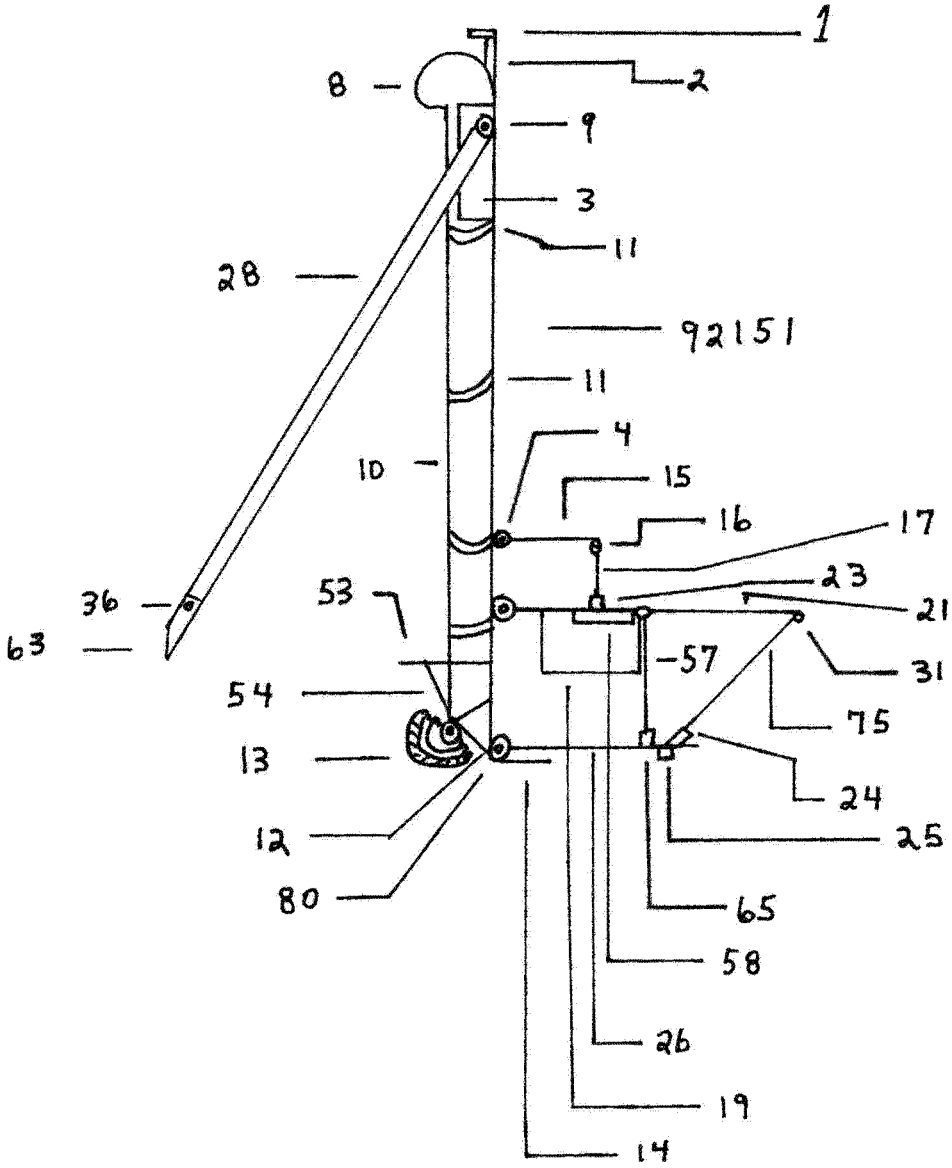

FIG. 9 is a side angle view of present invention Main Body Frame 92151 and said represents a single line drawing/illustration of said in an upright position and only featuring and indicating some of its embodiment aspects, such as from what is to be considered its Top aspects resented as its Head Rest Embodiments to its Bottom aspect(s), being its Wheel/Tire Assembly and its Feet Platform which includes all embodiments in between them, but is not limited to embodiments herein stated, described, illustrated, drawn, etc., and said embodiment(s) are in what is to be considered having its platforms and their attributes in their collapsed state or in a laid back/storage-able/transportable position.

Figure 10:
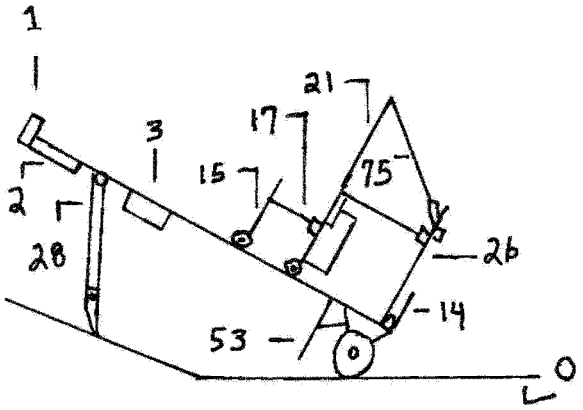

FIG. 10 is a side angle view of present invention Main Body Frame 92151 and said represents a single line drawing/illustration of said engaged in one of its reclining position(s) and with its Rear Reclining embodiment shown in a reclining position(s) and only featuring and indicating some of its embodiment aspects, such as from what is to be considered its Top aspects resented as its Head Rest Embodiments to its Bottom(s) aspect(s), thus being its Wheel/Tire Assembly/Feet Platform which includes all embodiments in between them, but is Not limited to embodiments herein stated, described, illustrated, drawn, etc., and said embodiment(s) are in what is to be considered having its platforms and their attributes in their collapsed state or in a laid back/storage-able/transportable position.

Figure 11:
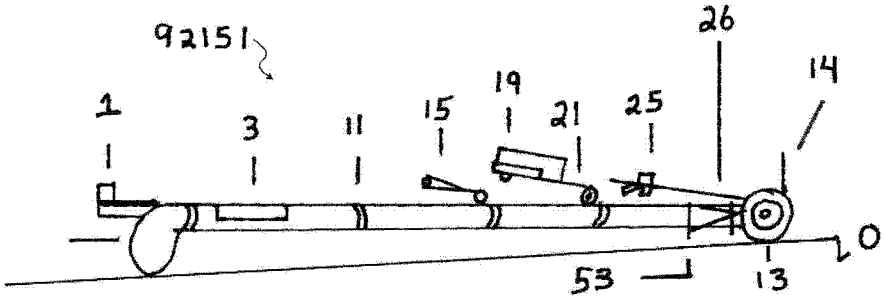

FIG. 11 is a side angle view of present invention Main Body Frame 92151 and said represents a single line drawing/illustration of said in an ground level type position and only featuring and indicating some of its embodiment aspects, such as from what is to be considered its Top aspects resented as its Head Rest Embodiments to its Bottom aspect(s), being its Wheel/Tire Assembly/Feet Platform which includes all embodiments in between them, but is Not limited to embodiments herein stated, described, illustrated, drawn, etc., and said embodiment(s) are in what is to be considered having its platforms and their attributes in their collapsed state or in a laid back/storage-able/transportable position.

Figure 12:
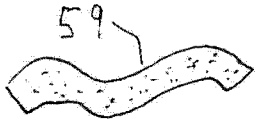

FIG. 12 is a top side Birds Eye view of present invention Main Body Frame 92151 of a type of known Hook and Loop embodiment (Velcro®), or the like that can be used herein as an Immobilization/Stabilization Strip.

Figure 13:
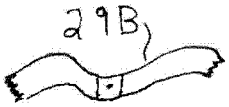

FIG. 13 is a top side Birds Eye view of present invention Main Body Frame 92151 of a type of known Seat Belt embodiment or the like that can be used herein as a Seat/Derriere Immobilization/Stabilization type Belt.

Figure 14:
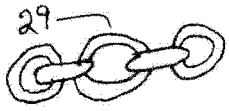

FIG. 14 is a top side Birds Eye view of present invention Main Body Frame 92151 use of a type of known Chain embodiment or the like that can be used herein as the Rear Recliner distance travel controller embodiment and or the embodiment to/for locking the Main Body Frame 92151 Platforms in end user desired position(s) for transporting/storage, etc.

Figure 15:
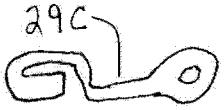

FIG. 15 is a top side Birds Eye view of present invention Main Body Frame 92151 of a type of known Bar embodiment or the like that can be configured and used herein as the Rear Recliner distance travel controller embodiment and or the embodiment to/for locking the Main Body Frame 92151 Platforms in end user desired position(s) for transporting/storage, etc.

Figure 16:
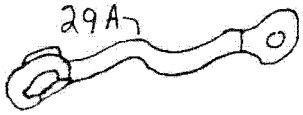

FIG. 16 is a top side Birds Eye view of present invention Main Body Frame 92151 of a type of known Cable embodiment or the like that can be used herein as the Rear Recliner distance travel controller embodiment and or the embodiment to/for locking the Main Body Frame 92151 Platforms in end user desired position(s) for transporting/storage, etc.

Figure 17:
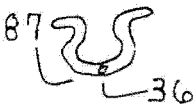

FIG. 17 is a side angle view of a type of known Utility Clip Bracket 87 embodiment for hanging items usable with present invention.

Figure 18:
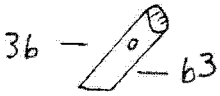

FIG. 18 is a side angle view of a type of an embodiment for use on the Rear Recliner Leg(s) Support Embodiment 28 referred herein as the Spike Leg Ends 63 embodiments that's usable with present invention.

Figure 19:
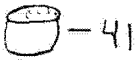

FIG. 19 is a side angle view of a type of an embodiment for use on the Rear Recliner Leg(s) Support Embodiment 28 referred herein as the Cup Leg Ends 41 embodiments that's usable with present invention.

Figure 20:
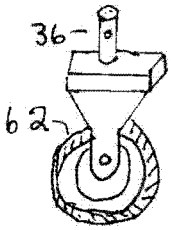

FIG. 20 is a top side angle view of a type of an embodiment for use on the Rear Recliner Leg(s) Support Embodiment 28 referred herein as the Wheel-able Leg Ends 62 embodiments that's usable with present invention and the embodiments.

Figure 21:
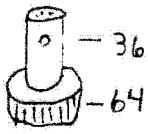

FIG. 21 is a side angle view of a type of an embodiment for use on the Rear Recliner Leg(s) Support Embodiment 28 referred herein as the Flat/Angled Leg Ends 64 embodiments that's usable with present invention and the embodiments.

Figure 22:
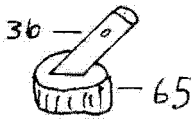

FIG. 22 is a side angle view of a type of an embodiment for use on the Rear Recliner Leg(s) Support Embodiment 28 referred herein as the Angled Leg Ends 65 embodiments that's usable with present invention and the embodiments.

Figure 23:
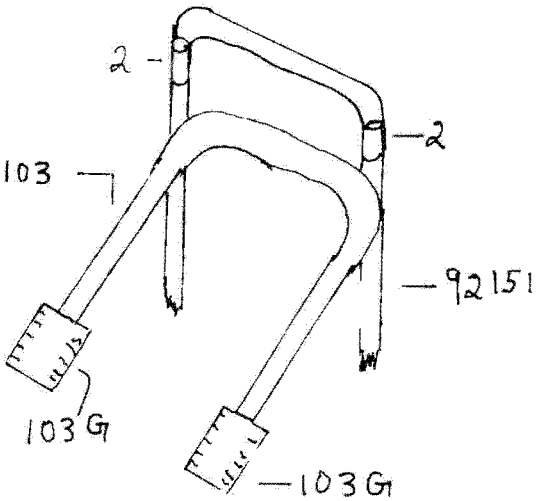

FIG. 23 is a top side angle view of a type of Finger/Hand Grip Handle Bars 103G with finger-handle grip embodiments on the Handle unit that's usable on the Main Body Frame 92151, the present invention.

Figure 24:
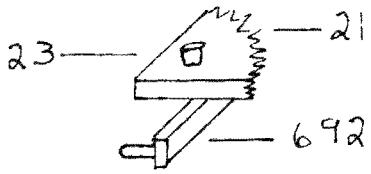

FIG. 24 is a top side angle cutaway view of the Seat Platform 21 featuring an optional Under Seat Platform to Leg Platform Extension(s) Embodiment through method and that its seen as a geometric shape Elbow type embodiment which is attached to and under the Seat Platform providing necessary movement/connection of said embodiment on a male/female type connection.

Figure 25:
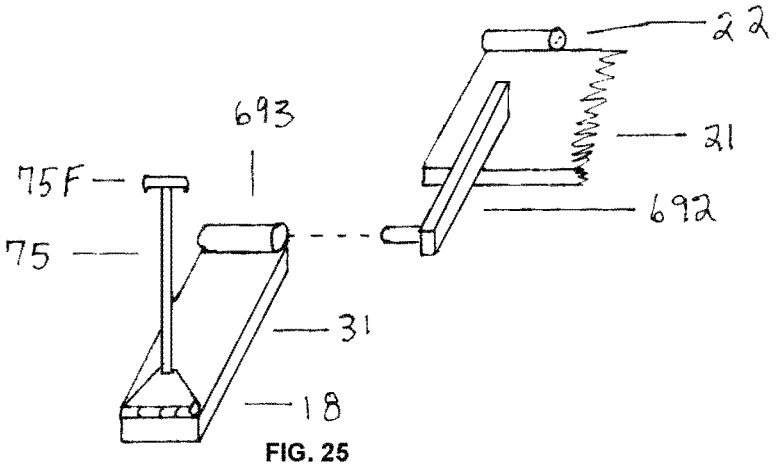

FIG. 25 which features an inverted (upside down) side angle cutaway view of the Under Seat Platform 21 with the geometric shape Elbow Embodiment with the Leg Platform Extension(s) Embodiment shown with a capable a male/female type corresponding connection for the Leg Platform Extension(s) embodiment that can be inserted to it receiving embodiment.

Figure 26:
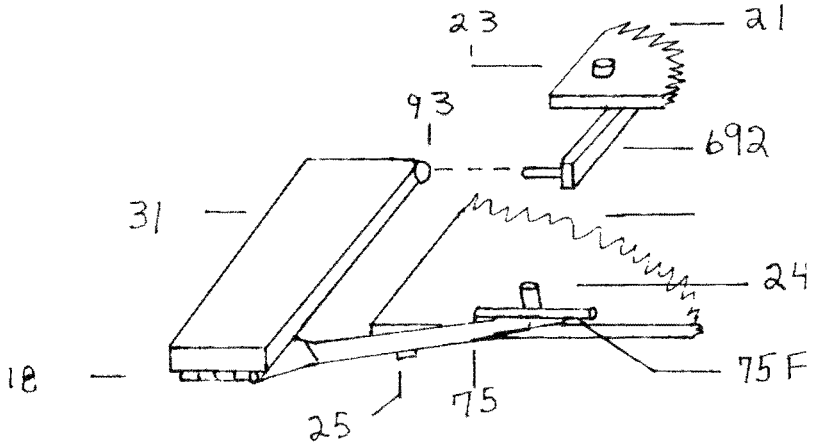

FIG. 26 which features a front upright topside angle cutaway view of the Under Seat Platform 21 that has an attachment with an embodiment geometrically shaped like an Elbow type and shown is a Leg Platform Extension(s) embodiment and is capable of connecting to the Seat Platform in a male/female type manner with its corresponding connections and said has other embodiments features.

Figure 27:
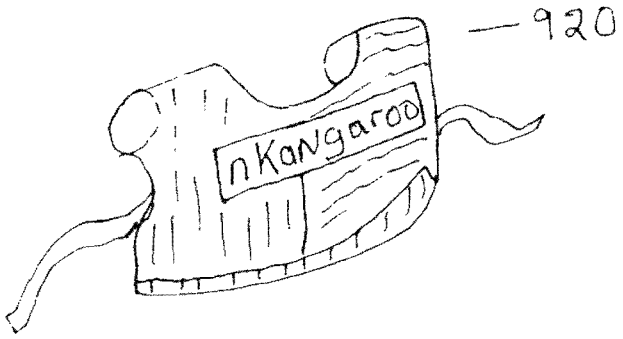

FIG. 27 is a top side rear angle view of an instrument garment 920 of high visibility pattern(s) and fabric(s)/(half and half colored) and features insignia such as nKangaroo™, also it has capabilities of having safety equipment in its storage compartments as well as indicate the location of the Athlete Transporter System Apparatus Device System and the Medical/Stress Rescue personnel.

Figure 28:
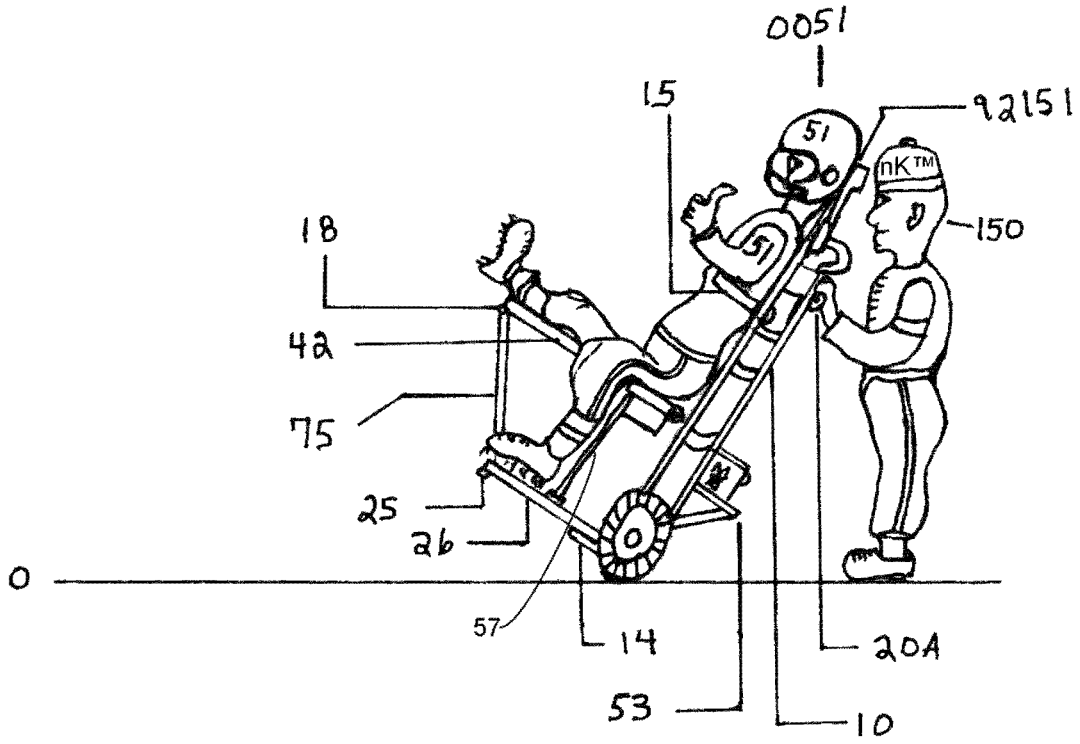

FIG. 28 is a side angle view of the Main Body Frame 92151 with an Athlete/Individual 0051 in said, in the transport position and an individual 150 who is maneuvering the nKangaroo™ (Present Invention), featuring the uses of the Arm Rest Platform 15, the Leg Extension Platform 42, the Leg Extension Platform Pivotal Mechanism 18, the Leg Extension Platform Extension 75 as well as the MBF 92151 Feet Platform 26, the Feet Platform Stopper 25, the Toe 14, the Medical Box Platform 53, the MBF Center Support 10 (optional), the Push/Pull Tow Handle 20A and the Ground Level O, in which the above stated FIG. 28 illustration is shown to be featured leveled on.

DETAILED DESCRIPTION

Figure 1:
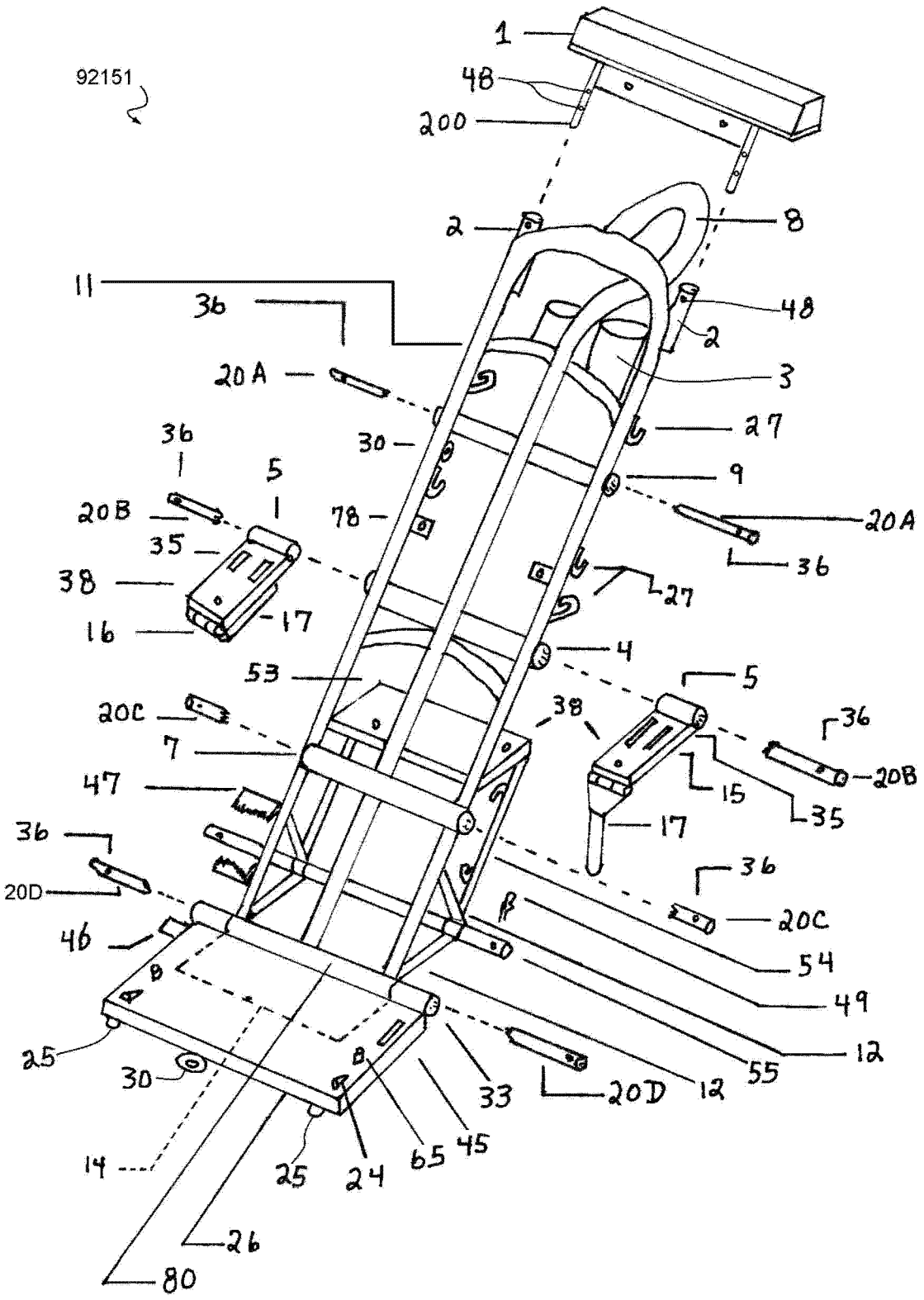
FIG. 1 presents a top side frontal angle view of the present invention featuring its Head Rest Assembly embodiments and a type of Padding (or not) for it and its type of Head Rest Mounting Brace Port Base embodiment and its Liquid/Oxygen Tank Holder(s) or the like and its Arm(s) Platform(s) Rod/Shaft Support Port System part(s) that provides its pivotal motion and its Arm(s) Platform(s) with its Rod/Shaft Port(s) and its Seat Rod/Shaft Port Support System embodiment that provides its pivotal motion and its Seat Platform Rod/Shaft with its Port System embodiment that provides its pivotal motion and its Feet Rod/Shaft support System that provides pivotal motion.

Referring now to the drawings/illustration that have like numerals representing like parts herein, as in FIG. 1 which is a frontal top side angle view of the herein present invention illustrating and featuring the Main Body Frame (M.B.F.) 92151 and some of its embodiments which consist of its Head Rest Assembly Unit embodiment 1 and the/a type of Head Rest Mounting Brace/Bracket Port Base 2 for it, its Liquid Holder(s)/Oxygen-Air Tank Container Holder(s) 3 or the like, its Arm(s) Rod/Shaft/Bar Support Housing System 4 that provides pivotal motion for the Arm(s) Platform(s) Rod/Shaft Port Base 5 and the Arm Pass through Rod/Shaft, Axle/Tube 20B embodiment for said or the like providing pivotal motion and the Seat Rod Shaft Platform Housing System 7 embodiment that provides pivotal motion for the Seat Pass through Rod/Shaft, Axle/Tube 20C embodiment for said and the Feet Rod/Shaft/Bar Housing Support System 80 embodiment providing pivotal motion for and the Seat Pass through Rod/Shaft, Axle/Tube 20D embodiment for said and the Main Body Frame 92151 {M.B.F.} Center Support 10 embodiment whereas the/its upper section forms the geometric shape "P" Handle Area 8 section and the "T" Handle Rod/Shaft Housing Support System 9, and the "T" Handle 20A is the Push/Tow aspect which also is for the operation of the Rear Recliner Leg(s) Unit 28 (not shown in FIG. 1) providing its pivotal motion capabilities and seen is the whole Center Support 10 embodiment of the Main Body Frame 92151 embodiment (an optional embodiment-Upper 8 and Lower).

With reference to FIG. 1, the Main Body Frame 92151 multiple Horizontal Back Support 11 embodiment(s) and the Wheel/Axle Brace support(s) 12 assembly embodiment(s) and the Tire/Wheel Unit 13 assembly embodiments and the Main Body Frame 92151 part known as the Toe 14 is a standard embodiment part and the Arm(s) Rest Platform(s) 15 unit assembly embodiment that provides movement and the Arm(s) Rest Platform(s) Frontal Hinge 16 embodiment (s) unit assemblies whereas when its Support Extension part 17 assembly is deployed, it is placed on its pre-position Base Seat embodiment 23 (not shown in FIG. 1), located on the Seat Platform and the Under-Seat Platform Storage Compartment 19 embodiment (not shown in FIG. 1 and optional) and representing a type of Pass through Rod/Shaft/Axle/Column, Tube 20 type embodiment part(s), etc., as on the Head Rest or the like which can be vertical/horizontal (with apertures for adjustment/attach-ability/detach-ability/store-ability), on the M.B.F. 92151, as with the insert-able Head Rest Unit 1 which is inserted into its/the "Port Base(s) 2 Mounting System embodiment part(s) which provides apertures for adjustment/attachable-detachable movement of the said embodiment part(s) and seen are the Arm Rest Platform(s) 15 unit assembly embodiment and said has Immobilization/Stabilization Strip Apertures 35, its storage apertures 38 and shown are some of its mounting accessory Flanges (Tabs) 78 with apertures.

Also seen in FIG. 1 is its Feet Platform Stoppers 25 and the Leg Extension Platform pre-position Base Placement Seat 24 embodiment(s) and a type of known Loop 30 embodiment part and shown is the Head Rest Aperture(s) 48 for Head Rest embodiment(s) 1 adjustments/attachment/detachment of said and shown is a known type Cotter Key 49 (Bolts, Pins etc., or the like can be used) to retain Rod/Shaft/Axle or the like in desired position(s) and the Feet Platform Ports 33 for pivotal movements and the Feet Platform Housing 80 for pivotal movement and the insertion of Rod/Shaft/Axle/Tube 20D, etc., and the M.B.F. 92151 known standard Toe 14 indicated by broken lines at the base (underside) of the M.B.F. 92151 and the Feet Platform Hand/Finger(s) Aperture 45, seen as well are Implement Accessory Hooks 27, apertures for Cotter Keys, Pins, Bolts, etc. 36 or the like for restraining in desired position(s) embodiment(s), apertures for embodiment storage 38, its Medical Box/Bag Platform 53, its Medical Box/Bag Platform support brace-bracket 54, a cutaway view of its Tire/Wheel Guard 47, a view of the Feet Platform 26, a type of Handle for its Feet Platform 46 and its pre-determined Seat Platform Extensions seat guides 65 are illustrated herein FIG. 1.

Figure 2:
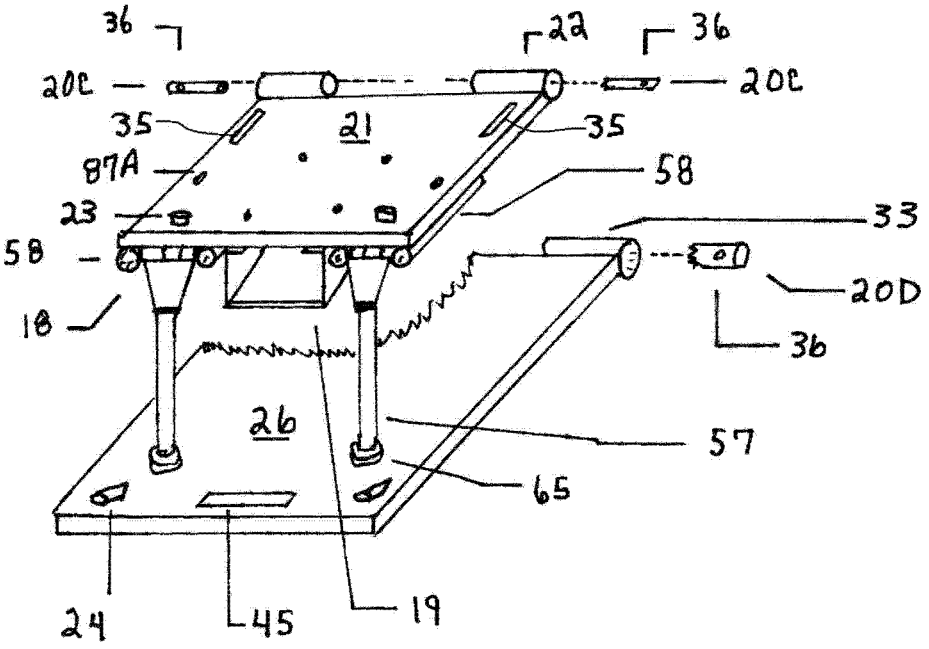
FIG. 2 illustrates a Seat/Derriere Platform embodiment suspended over the Feet Platform that's both pivotal and the Seat/Derriere Platform Frontal Hinge embodiment(s) part(s) mechanism(s) Unit assemblies, its Arm(s)/Leg(s) Platform(s) Base Seat Embodiments and its Seat Platform(s) Hinged Leg(s) Extension(s) and their Support parts, that are to be placed/seated in their pre-determined Leg(s) Base Seat Embodiments on the Feet Platform, its Seat/Derriere Platform Ports embodiment parts which provides for their respected Pass Through Rod/Shaft/Axle/Column, Tube etc., that provides it pivotal/movement (attachable-detachable/storage positions) and allows the Pass Through Rod/Shaft/Axle/Column, Tube embodiment part, etc., or the like which is to be inserted into them and through the Seat/Feet Platforms, its Seat/Derriere Platform pivotal support Leg(s) Length Sections pre-position/determined Resting Base Seat embodiments that's located on the Seat/Feet Platform embodiments, its Leg Extension pre-position Base Seat Embodiment part is located on the Feet Platform embodiment part for the placement of the Leg Extension Support Bar End(s) and said is Hinged (movable), its Under Seat Leg(s) Duel Leg Extension Receptacles, its M.B.F. Open Space area, its Under Seat Storage Compartment (optional), its Seat Belt Apertures, its Arm(s) Base Seat embodiments, its Feet Platform Handle(s) type, a cutaway view of a/its Pass Through Rod/Shaft/Axle/Column, Tube embodiment parts, etc., or the like, its Seat Padding/Cushion (optional) Mounting Apertures, its Storage Aperture.

FIG. 2 is an upright frontal top sided angled view that features the detached Seat/Derriere Platform 21, detached from the Main Body Frame 92151 super-imposed over the Feet Platform 26, whereas the detached Seat/Derriere Platform 21 shows its Rear Ports 22 for attachment to the M.B.F. 92151 and for pivotal movement on its/a cutaway view of its insert-able Rod/Shaft/Axle/Column/Tube 20C embodiment part or the like, its Platform(s) Hinged pre-position Base Seat 23 embodiment part on the Seat Platform, the Under Seat Storage Compartment 19 (optional), its Under Seat to Leg(s) Extension(s) Rod/Shaft/Axle/Column/Tube 58 support system embodiments, its frontal Pivotal Hinged Mechanisms 18 with is Extension Section 57, its open space 61 for the M.B.F. 92151 to be placed/inserted, also seen is the Feet Platform 26 highlighting its attached Base Rear Ports 33 for pivotal functions, its pre-determined Seat Platform Seat Base embodiments 65 located on the Feet Platform 26, its optional Hand Handle type Aperture 45, its Under Seat Storage Unit Apertures, its aperture for Finger/Hand use in the Feet Platform, apertures for Stabilizing Strip(s)/Belt for immobilization purposes, apertures for locking embodiments 87A, its optional Under Seat Platform Storage Unit 19, its Feet Platform Shaft, Rod, Tube, etc., 20D or the like for pivoting purposes its Feet Platform Leg Extension predetermined Base Placement Seat embodiment 24, its apertures for Cotter Key, Pins, Bolts 36 or the like for embodiment restraining positioning.

Figure 3:
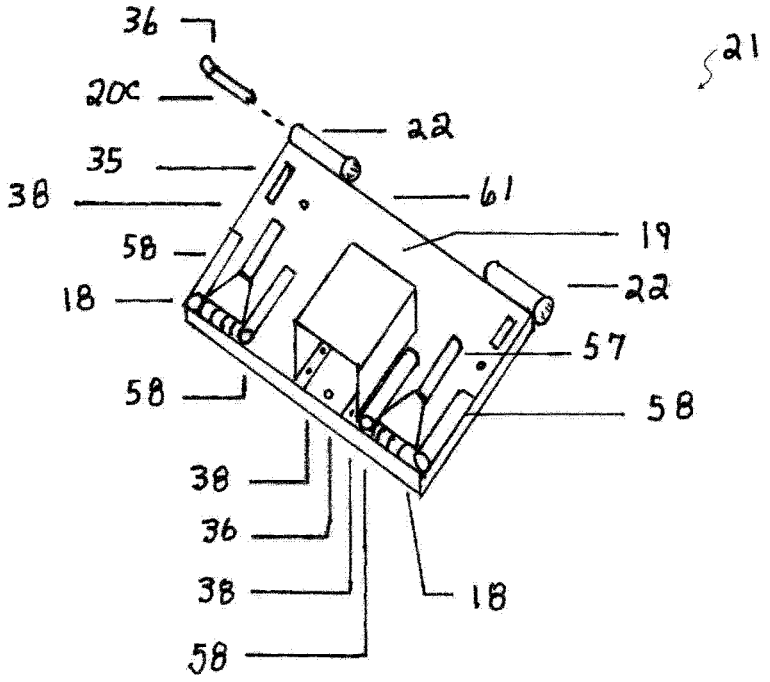
FIG. 3 illustrates a frontal top sided angle view of the Seat Platform embodiment part inverted (upside down), with some of its embodiments in their collapsible/storage/transportable/not in use positions and with its Pivotal Ports embodiment parts which provides for its respected Pass Through Rod/Shaft/Axle/Column, Tube etc., or the like for it to pivot and the Seat/Derriere Platform Frontal Hinge embodiment(s) part(s) Support parts and said is Hinged/movable, its Under Seat Leg(s) Duel Leg Extension Apertures, its Seat Belt Apertures, its Seat Padding/Cushion Mounting Apertures, its Storage Aperture.

FIG. 3 is an illustrated frontal top sided angle view of the Seat Platform 21 Embodiment Part inverted (upside down), featuring the Seat Platform Base Ports 22 for its Seat Platform Pass through Rod/Shaft/Axle/Column, Tube 20C etc., or the like, its Seat Platform Open Space 61 for it to be attached to the Main Body Frame 92151, its Seat Platform Seat Belt Apertures 35, its Under Seat Platform Leg(s) Extension Receptacles 58, its optional Under Seat Platform Storage Compartment 19, its optional Under Seat Platform Storage Compartment Apertures 19, its Seat Platform Frontal Hinged Pivotal Support 18/Seat Leg(s) 57 embodiments, its Hinged Pivotal Support Seat Leg(s) sections/portions 57, its Storage/Mounting Aperture(s) 38, its Hinged Pivotal Support Seat Leg sections/portions Storage Utility Clip(s) 87 type embodiment/M.B.F. Standard Storage Utility Snap In Clip[s] 87 type for appropriate embodiments/in appropriate locations to retain said embodiments in position (optional), its Seat Platform Seat Padding/Cushion Mounting Apertures 38 and seen are some of its embodiments in their collapsible/storage/transportable (shown in their not in use or deployed positions) positions and also seen is its 20C Shaft, Rod, Tube, etc., or the like for pivoting purposes, its M.B.F. Open Space 61 for embodiment(s).

Figure 4:
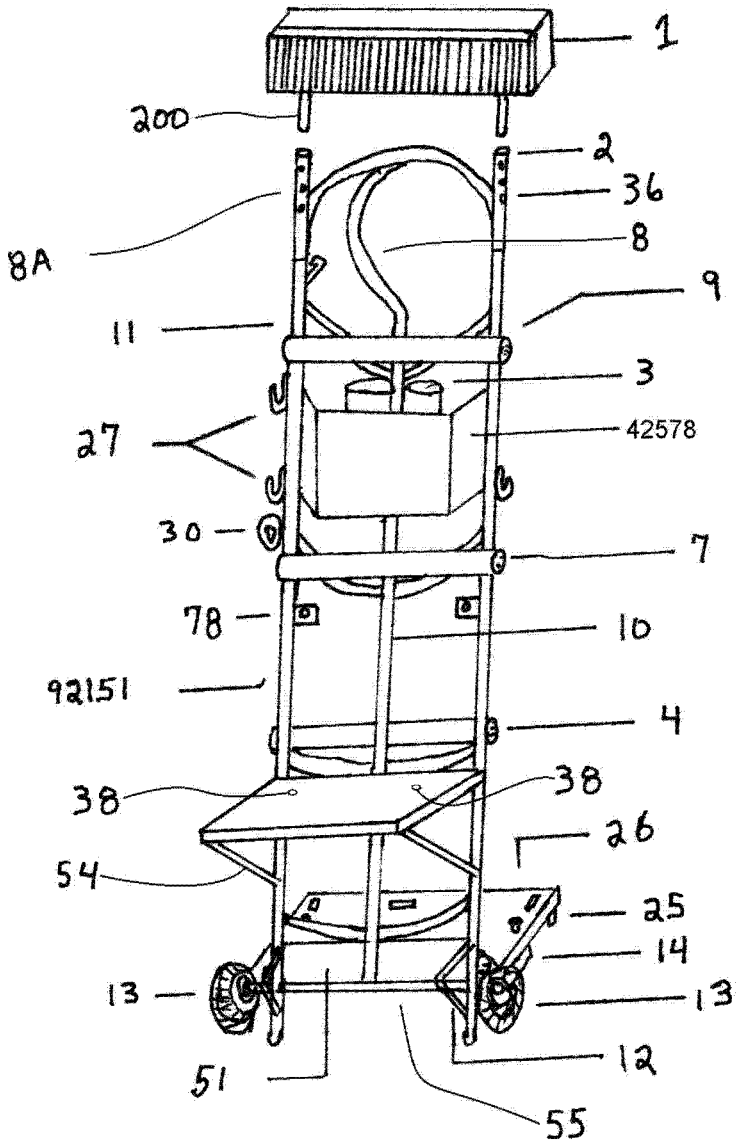
FIG. 4 is a view of what is the present invention rear or backside, highlighting its Head Rest/Frame and the Head Rest insert-able ports and their receptacles, its "P", Curved-Loop and "T" type Handles, its Pass Through Rod/Shaft/Axle/Column, Tube etc., or the like for the "T" Handle to pivot with it Cotter Key/Pin or the like Apertures, its Center Support embodiment, its Center Support embodiment supports, its Liquid/Oxygen Containers Holders with their Cover Plate, its Retainer Loop, its M.B.F. Accessory Hooks, its Push/Tow/Bar-Rear Recliner Housing embodiment, the Arm(s), Seat and Feet Platform Housings embodiments, its Medical Box/Bag Supply Platform Supports, its Medical Box/Bag Supply Platform, its Medical Box/Bag Supply Platform Mounting Apertures, its Heel Embodiment (optional), its M.B.F. Axle Unit and its Support S1ystem, its M.B.F. Wheel/Tire Unit Mechanisms, its M.B.F. Wheel/Tire Guards, its M.B.F. Toe Embodiment, its M.B.F. Feet Platform, its M.B.F. Feet Platform Stopper(s)/Bumper(s).

FIG. 4 is a view of what is the present invention rear or backside of the Main Body Frame 92151 highlighting its Head Rest/Frame 1 and the Head Rest insert-able Post(s) 200 and their vertical type Receptacle Ports(s) 2 and with its adjustment Apertures 36, its "P" type Handle 8, its Curved type Handle 8A, its "T" type Handle Pass Through Rod/Shaft/Axle/Column/Tube 9 etc., or the like for the "T" Handle 20A, etc., its Center Support 10 embodiment (Optional), its M.B.F. Cross Brace/Bracket 11 embodiment, its Liquid/Oxygen Holder(s) 3 with its Liquid/Oxygen Container Holders Cover Plate 42578 embodiment, its Distance Travel Retainer Loop 30 (location varies), its M.B.F. Accessory Hook(s) 27, its Rear Recliner Handle Unit assembly embodiment Pass Through Rod/Shaft/Bar/Axle/Tube 9, its Arm(s) Housing Embodiment 4 for pivoting capabilities, its Seat Housing Embodiment 7, its Feet Platform Housings embodiment 80, its Medical Box/Bag Supply Platform Supports 54, its Medical Box/Bag Supply Platform Mounting Apertures 38, its M.B.F. Heel 51 (optional), its M.B.F. Axle Unit 55, its M.B.F. Wheel/Tire Unit Mechanisms 13, its M.B.F., its M.B.F. Toe Embodiment 14, its M.B.F. Feet Platform 26, its M.B.F. Feet Platform Stopper(s)/Bumper(s) 25, its mounting flange(s) 78, Head Rest Insert-able mount embodiments 200.

FIG. 5A is a frontal top side angle view of present invention Main Body Frame 92151, featured with section(s)/portion(s) of the Main Body Frame (M.B.F.) 92151 covered with a known material in a sectional plate type manner (said is attached to M.B.F. in known manners/methods), and said known material is metal Diamond Plate, a Sheet Metal and or the like (said coverage/with or without like type) and or the Main Body Frame 92151 can be Painted/unpainted/Powered Coated, Fabric covered, Carbon Fiber, etc., or a combination thereof of a known material(s) and or of some appropriate material according to the end users desire and said such embodiment sections/portions as stated herein for consideration is from top of the Head Rest/Frame Cover Plate/Padded Section 102578, its Seat Back Front Plate Cover Section 32802, its Seat/Derriere Platform Cover Plate Section 10412, its Arm(s) Platform(s) Cover Plate Section 121098, its Liquid/Oxygen Containers Cover Plate Section 42578, the Under Seat Frontal Cover Plate Section 111997, its Feet Platform Cover Plate Section 7415, its Leg(s) Extension(s) Platform(s) Cover Plate Section 6605, its Wheel/Tire Guards Cover Plate Section(s) (optional/(if any/not shown)), the M.B.F. 92151 Rear Cover Plate 333 (see FIG. 5K) section and all Embodiments in between its top where a Cover Plate is or the like is/can/may-be appropriately covered and its Rear Recliner Cover Plate 95 and its Rear Recliner cover Plate Storage Compartment 96, also seen is its "P"-Handle 8 section, a cut view of the Push/Tow Handle and Rear Recliner Shaft/Rod/Tube, etc. or the like ends 20A, a Cotter Key 49/its aperture, M.B.F. 92151, Liquid/Oxygen Cover Plate 42578, Tow/Push Handle Base Housing Embodiment 9, Arm(s) Base Housing Embodiment 4, Arm(s) Shaft/Rod/Tube, etc. or the like ends 20B with apertures, Arm Port Base 5, Arm Platform 15 Cover Plate 121098, Arm Hinged Extension 17, Seat Platform Base Port 22, Seat Platform Shaft/Rod/Tube, etc. or the like ends 20C with apertures 36, the Medical Box/Bag Platform 53, the Medical Box/Bag Platform Signature mounting Flange/Tab 78, Feet Platform Base Port 33, the Feet Platform 26 Cover Plate 3507, FIG. 5G is a Medical Box/Bag Platform Cover Plate 7415, FIG. 5H is a Medical Box/Bag Brace/Bracket Platform Signature type Cover Plate 800, FIG. 5I is a Head Rest Non-Padded Cover Plate 102578 and FIG. 5J is an Arm(s) Cover Plate 121098, FIG. 5K is a M.B.F. type Signature/M.B.F. Rear Cover Plate 333, FIG. 5L is a Head Rest Padded embodiment with Stud mounting exposed 222S for attachment to Head Rest Frame unit embodiment, FIG. 5M is a Below Seat Frontal Cover Plate 111997 and FIG. 5N is an optional Rear Storage Compartment Unit 96 for M.B.F. Cover Plate or its Rear Recliner Unit 28 Signature Cover Plate 333 or the like, FIG. 5P is the Seat to Leg(s) Extension Cover Plate 6605, FIG. 5Q is a Liquid/Oxygen Cover Plate 42578 (NOTE: all said embodiments have necessary/appropriate corresponding storage/mounting apertures/options as required/needed).

FIG. 6 is a frontal top side angle view of present invention Main Body Frame Rear Recliner Leg(s) Unit 28 Embodiment part(s) with a Chain Loop 30, its Cross Bar Support Embodiment 28CB part and a view of a known type of Chain 29, for the Rear Recliner Leg(s) Unit 28 embodiment to limit travel distance (restrain) from the Main Body Frame 92151, when used with hook/latch embodiment or the like for said purpose(s)/(is optional) and its Tow Handle Base Port(s) 34 embodiment part ("T" Handle 20A) and a cutaway view of its Tow Handle Pass Through Rod/Shaft/Axle/Column, Tube 20A embodiment part, etc., or the like which is inserted into the end and the Tow Handle Pass Through Rod/Shaft/Axle/Column/Tube Housing 9 embodiment part and said provides pivotal movement of/for the Rear Recliner Leg(s) Unit 28 embodiment and its M.B.F. 92151 Open Space 61 area, for said to be placed, its optional Legs Flat End (Angled End) 64 embodiments with its Aperture 36, also seen are it some of its mounting Flanges 78.

FIG. 7 is a top right side cutaway angle view of present invention Main Body Frame 92151 and the Feet Platform 26, illustrating a cutaway view of its Feet Platform Base 26 and its Base Port 33, its Seat Platform Support Hinged Mechanism Extension End 57, which is to be placed in/on its Feet Platform in/on the Pre-Position Base Seat/Resting Embodiment 65 on the Feet Platform 26 and also seen is a cutaway view of the Seat to Leg(s) Extension Platform Hinged Mechanism Extension Extended section/portion Embodiment 75, which is to be placed in/on the/its Leg Extension Hinged Pre-Position Base Seat/Resting Embodiment 24 located on the Feet Platform 26, its Feet Platform Handle 46 (an optional type), its Feet Platform Base Port 33, that is for pivotal movement/insertion and a cutaway view of the Rod/Shaft/Tube 33, etc. embodiment, an optional Handle type for the Feet Platform, a cutaway view of the Seat Platform Hinged Extension embodiment for/on the Feet Platform 57, a cutaway view of the M.B.F. Heel section 51 as well as the perforated lines indicating the Toe Embodiment 51.

FIG. 8 is a rear top side angle view of present invention Main Body Frame 92151 Seat Platform 21 to Leg(s) Extension Platform(s) 31 with its Apertures for Immobilization/Stabilization Strips 35, its Storage Aperture 38, its Duel Rod/Shaft/Tube 42 etc., or the like that are to be inserted into their corresponding Under Seat Duel Insertion Rod/Shaft/Tube, etc., Receptacles 58 or the like in a known male/female typed manner/method for connection(s), its Apertures for its Cover Plate 36, etc., for the Leg Extension Platform 31, its Leg Extension Platform Frontal Hinged Mechanism 18 Embodiment, its Leg Extension Platform Support Section/Portion 75 Embodiment(s).

FIG. 9 is a side angle view of present invention Main Body Frame 92151 and said represents a single line drawing/illustration of said in an upright position only featuring and indicating some of its embodiment aspects, such as from what is to be considered its Top aspects represented as its Head Rest Embodiments 1 to some of its Bottom/Lower aspect(s), being its Wheel/Tire Assembly 13/Feet Platform 26, which includes but is NOT limited to what is to be considered with its platforms in their collapsed state or in a laid back/storage-able/transportable position and some highlighted embodiments featured are its Head Rest 1, Head Rest Shaft/Rod/Tube, embodiment 2 etc., or the like, Push/Tow Shaft/Rod/Tube, etc., Housing embodiment, Liquid/Oxygen Holder 3, M.B.F. Center Support Member 11 (optional), M.B.F. 92151, Rear Recliner Unit 28, Horizontal Cross Member Support 11, Arm(s) Platform Base Housing Support Embodiment 4, Arm Platform Embodiment 15, Arm Platform Hinged Mechanism and Extension 16, Arm Platform Hinged Mechanism and Extension Embodiment Section 17, Leg Extension Platform 21, Seat Platform Hinged Embodiment Extension 57, Leg Extension Platform Hinged Mechanism embodiment 31, Leg Extension Platform Hinged Mechanism Embodiment Extension 75, the Leg Extension-Extension Base Seat Rest Embodiment 24, Seat Platform Hinged Mechanism Extension Base Seat Rest embodiment 65, Under Seat Leg Extension Insert Receptacle Embodiment 58, Under Seat Storage Compartment 19, Feet Platform 26, Toe Embodiment 14 of M.B.F. 92151, Feet Platform Base Housing Embodiment 80, Axle/Tire/Wheel Unit Brace-Bracket embodiment 12, Axle/Tire/Wheel Unit 13 Axle/Tire/Wheel Unit, Feet Platform Stopper-Bumper embodiment 25, Medical Box/Bag Platform Brace-Bracket embodiment 54, Medical Box/Bag Platform 53, Rear Recliner Unit Spike End embodiment 63, Aperture(s) for Cotter Key(s), Pin(s), Bolts 36, etc., or the like.

FIG. 10 is a side angle view of present invention Main Body Frame 92151 and said represents a single line drawing/illustration of said in one of its reclining position(s) and with its Rear Reclining 28 embodiment shown in a said reclining open position and only featuring and indicating some of its embodiment aspects, such as from what is to be considered its Top aspects represented as its Head Rest Embodiments 1 and its Head Rest Shaft/Rod/Tube, embodiment 2 to its Bottom/Lower aspect(s), being its Wheel/Tire Assembly 13/Feet Platform 26 which includes but is NOT limited to embodiments herein stated, described, illustrated, drawn, etc., and said embodiment(s) are in what is to be considered with its platform(s), in their collapsed state or in a laid back/storage-able/transportable position and some highlighted embodiments featured additionally are its Liquid/Oxygen Holder 3, Rear Recliner Unit assembly 28, Arm(s) Platform embodiment 15, Arm Platform Hinged Mechanism and Extension Embodiment Section 17, Leg Extension Platform 21, Leg Extension Platform Hinged Mechanism Embodiment Extension 75, Feet Platform 26, Toe Embodiment 14 of M.B.F. 92151, the Medical Box/Bag Platform 53 and the Ground/Floor level is O.

FIG. 11 is a side angle view of present invention Main Body Frame 92151 and said represents a single line drawing/illustration of said in what is to be considered a ground/floor level position and only featuring and indicating some of its embodiment aspects, such as from what is to be considered its Top aspects represented as its Head Rest Embodiments 1 to its Bottom/Lower aspect(s), being its Wheel/Tire Assembly 13/Feet Platform 26 which includes but is NOT limited to its embodiments herein stated, described, illustrated, drawn, etc., and said embodiment(s) are in what is to be considered with its Platforms in their collapsed state or in a laid back/storage-able/transportable position and some highlighted embodiments featured additionally are its "P"-Handle 8, its Head Rest Embodiments 1, Liquid/Oxygen Holder 3, Horizontal Cross Member Support 11, Arm Platform Hinged Mechanism 15 with its Extension Embodiment Section, the Under Seat Storage Compartment 19, Seat Platform 21, Feet Platform Stopper/Bumper 25, Feet Platform 26, M.B.F. 92151 Toe Embodiment 14, the Medical Box/Bag Platform 53 and the Ground/Floor level is O.

FIG. 12 is a top side Birds Eye view of a type of known Hook and Loop 59 embodiment (Velcro®), or the like that can be used herein with present invention Main Body Frame 92151 as an Immobilization/Stabilization Strip.

FIG. 13 is a top side Birds Eye view of a type of known Seat Belt 29B embodiment or the like that can be used with present invention Main Body Frame 92151 herein as a Seat/Derriere Immobilization/Stabilization type Belt/Strap.

FIG. 14 is a top side Birds Eye view of a type of known Chain 29 embodiment or the like that can be used with present invention Main Body Frame 92151 as the Rear Recliner 28 Distance Travel Controller Embodiment and or the embodiment to/for locking the Main etc.

FIG. 15 is a top side Birds Eye view of a type of known Bar 29C embodiment or the like that can be configured and used herein as the Rear Recliner 28 distance travel controller hook mechanism embodiment and or the embodiment to/for locking the Main Body Frame 92151 Platform(s), in end user's desired position(s) for transporting/storage, etc.

FIG. 16 is a top side Birds Eye view of a type of known Cable 29A embodiment or the like that can be used with present invention Main Body Frame 92151 herein, as the Rear Recliner 28 distance travel controller embodiment and or the embodiment to/for locking the Main Body Frame 92151 Platforms in an end user's desired position(s) for transporting/storage, etc.

FIG. 17 is a side angle view of a type of known Utility Clip Bracket 87 embodiment for hanging items/tools, etc., usable with present invention Main Body Frame 92151 for item(s) retention.

FIG. 18 is a side angle view of a type of an embodiment for use on the Rear Recliner Leg(s) Support Embodiment 28 referred herein as the Spike Leg Ends 63 embodiment(s) with its aperture 36, that's usable with present invention Main Body Frame 92151.

FIG. 19 is a side angle view of a type of an embodiment for use on the Rear Recliner Leg(s) Support Embodiment 28 referred herein as the/a Cup Leg Ends 41 embodiments that's usable with present invention Main Body Frame 92151.

FIG. 20 is a top side angle view of a type of an embodiment for use on the Rear Recliner Leg(s) Support Embodiment 28 referred herein as the Wheel-able Leg Ends 62 unit embodiment(s), with its aperture 36, that's usable with present invention Main Body Frame 92151.

FIG. 21 is a side angle view of a type of an embodiment for use on the Rear Recliner Leg(s) Support Embodiment 28 referred herein as the Flat Angled Leg Ends 64 embodiments with its aperture 36, that's usable with present invention Main Body Frame 92151.

FIG. 22 is a side angle view of a type of an embodiment for use on the Rear Recliner Leg(s) Support Embodiment 28 referred herein as the angle Angled Leg Ends 65 embodiments, with its aperture 36 that's usable with present invention Main Body Frame 92151.

FIG. 23 is a top side angle view of a type of Finger Grip Handle Bar 103 (Bicycle known type) Handle Bar(s) embodiment with handle bar hand/finger grips 103G that's usable on the present invention Main Body Frame 92151.

FIG. 24 is a top side angle cutaway view of the Seat Platform 21 featuring an optional/additional Under Seat Platform 21 to Leg Platform Extension(s) Embodiment 31 connection method and means and that is being illustrated/seen as a geometric shape Elbow Embodiment 692 type, that is attached to and under the Seat Platform 21 and provides movement/connection of the Leg Platform Extension(s) Embodiment 31, on a male/female type connection whereas the Leg Platform Extension(s) Embodiment 31 and said has an appropriate type stopper on its extension end that is opposite its Hinged Mechanism 18 as seen in FIG. 25.

FIG. 25 which features an inverted side angle cutaway view of the Under Seat Platform 21 with a/the connection/attachment, the geometric shape Elbow Embodiment 692 and the Leg Platform Extension(s) Embodiment 31 has a capable a male/female type corresponding connection for/on the Leg Platform Extension(s) Embodiment 31 for insert receiving it, thus the Receptacle Embodiment 693 is for said type of connection and the Leg Extension(s) Embodiment 31 Frontal Hinged Extension 75 section has a type of Stopper 75F for placement on the Feet Platform 26 for its travel control.

FIG. 26 which features a front upright topside angle cutaway view of the Under Seat Platform 21 with a/the connection/attachment, the geometric shape Elbow Embodiment 692 and the Leg Platform Extension(s) Embodiment 31 that has a capable a male/female type corresponding connection for/on the Leg Platform Extension(s) Embodiment 31 for insert receiving it, thus the Receptacle Embodiment 693 is for said type of connection and the Leg Extension(s) Embodiment 31 Frontal Hinged Extension 75 section has a type Stopper 75F for placement on the view of the cutaway Feet Platform 26 for its travel control.

FIG. 27 is a top side rear angle view of an instrument garment 920 (Safety Devices/Gear within its self-contained pockets/pouches that correspond to implements on nKangaroo™) that features a half and half colored safety concept for protection and covering present invention when not in use and not worn by/of the operator(s), to indicate the location of the Athlete Transporter System Apparatus Device System and the Medical/Stress Rescue personnel.

FIG. 28 is a side angle view of the Main Body Frame 92151 with an Athlete/Individual 0051 in said, in the transport position and an individual 150 who is maneuvering the nKangaroo™ (Present Invention), featuring the uses of the Arm Rest Platform 15, the Leg Extension Platform 42, the Leg Extension Platform Pivotal Mechanism 18, the Leg Extension Platform Extension 75 as well as the MBF 92151 Feet Platform 26, the Feet Platform Stopper 25, the Toe 14, the Medical Box Platform 53, the MBF Center Support 10 (optional), the Push/Pull Tow Handle 20A and the Ground Level O, in which the above stated FIG. 28 illustration is shown to be featured leveled on.

I, having thus configured the Athlete Transporter Apparatus Safety Wheeled Device System ("Field to Sideline Rescue Transporter"™) as shown, explained, illustrated and stated herein is for an Athlete/Individual(s), to be seated as somewhat in a known normal chair manner using arms/derriere-seat/feet platforms as well as head rest when desired when potentially incapacitated with the need to be transported. This configuration of a wheel-able body frame, its embodiments such as the platform assemblies, etc., are/is for the transporting of an Athlete/individual from the/an activity sports field/court, etc., or the like to its sideline or desired destination for various reasons and under various circumstances. The apparatus device equipment can be stored/transported when said platforms are collapsed in a position, somewhat paralleled to the main body frame or when said platforms are in a non-perpendicular position to the main body frame, as well as when said platforms are detached or attached to what is to be considered the Main Body Frame and in said positions.

The foregoing embodiments of the present invention Main Body Frame herein, has been presented for purposes of illustration and description. They are not intended to be exhaustive or to limit the invention and its method/means of use to the precise forms disclosed herein and it can be appreciated by one skilled in the art that other styles configurations and modifications of the present invention can be incorporated into the teachings of the present inventions disclosure upon reading the specifications and that the embodiments shown and described herein are for the purposes of clarity and disclosure and not to limit the scope. The herein embodiments have been chosen and described in order to best explain the principles and practical application in accordance with the invention to enable those skilled in the art to best utilize the various embodiments with expected modifications as are sited to the particular use(s) contemplated. The present application includes such modifications and is not limited only by the scope of the claims of/for the present invention herein.

Exemplary Embodiments

A first exemplary embodiment for a multiple-mode athlete/individual rectangle geometric shape apparatus transporter with a main chassis base system device equipment with an axle attached wheeled elongated main chassis base frame with an upper and lower section, that is convertible to assume a type hand truck mode, with a pivotal attachable/detachable reclining rear balancing member embodiment and said embodiment member has optional ground ends opposite it pivotal mounting rotating ends, and device has types of platforms for the Arms, Hands, Legs, Back, Derriere, Feet and Head rest that's attachable/detachable platform embodiments, a medical container implement platform, housing unit platforms for containers/liquid-Oxygen and said has a multiple pull/push handle systems for maneuverability and control ease and said has equipment/implement/aid hooks, apertures for multiple purposes on the platforms and on the Main Body Frame.

A second exemplary embodiment of the athlete/individual-occupant transporter as in the first exemplary embodiment, further having a Main Body Frame chassis base being an elongated frame safety wheeled apparatus device has Arms, Hands, Legs, Back, Derriere, Feet platforms that have the capability of movement in a collapsible/known proper use position manner and to a storage position manner when not in occupant support use and they are capable of being attached/detached and or deployed in a position for use/not in use for support of said human body parts of the occupant.

A third exemplary embodiment of the athlete-occupant transporter as in the first exemplary embodiment, having a Main Base Frame elongated chassis frame safety wheeled apparatus device has an attachable/detachable Leg(s) unit/with a connection cross member from a right side and a left side member, at the upper rear area of the Main Base Frame chassis that has/allows rotating movement outward from Main Base Frame when in its vertical positioning for achieving tilting and allowing for positioning and said has means/mechanisms for limiting/restraining its travel distance from Main base Frame's rear area as well as does its Arms, Legs, Derriere, Feet platforms and their support mechanisms travel is limited to travel from on/the frontal Main Body Frame and its Head Rest travel distance is limited in its upward and downward/removal movement.

A fourth exemplary embodiment of the athlete-occupant transporter as in the first exemplary embodiment, wherein the athlete-occupant transporter main frame base elongated chassis frame safety wheeled apparatus device has an axle, axle support mechanism and systems to support its wheels and tires aspects, which also forms said herein total apparatus unit device.

A fifth exemplary embodiment of the athlete-occupant transporter as in the first exemplary embodiment, wherein the athlete-occupant transporter Main Base Frame geometric elongated chassis frame safety wheeled apparatus device has Arms, Legs, Feet, Head Rest platform embodiments with optional apertures/loops for storage/insertion of strips for immobilization/stabilization, etc., of said if desired by end user.

A sixth exemplary embodiment of the athlete-occupant transporter as in the first exemplary embodiment, wherein the athlete-occupant transporter main base frame elongated chassis frame safety wheeled apparatus device is made of known materials individually or in combination and such type are Steel, Iron, Aluminum, Plastic, PVC, Carbon Fiber, Leather, etc., and or the like.

A seventh exemplary embodiment of the athlete-occupant transporter as in the first exemplary embodiment, wherein the athlete-occupant transporter main base frame elongated chassis frame safety wheeled apparatus device has location spaces for attaching/detaching known type light systems for night use as well as day time use.

A eighth exemplary embodiment of the athlete-occupant transporter as in the first exemplary embodiment, wherein the athlete-occupant transporter main base elongated chassis frame safety wheeled apparatus device equipment whereas the Arms, Derriere and Feet platforms embodiments are pivotal on one end of it in which an axle, rod, pipe, bar, tube, etc., or the like is pass through said embodiment with locking end mechanisms and said is inserted into it for a known hinged type concept mechanism relationship between said embodiment parts and the on the opposite end of said same embodiments, there is and it has/have a hinged mechanism of and for same nature with support rod, pipe, bar, etc., connected to its side end and said embodiments are to be used by athlete-occupant to properly hold said in its forwardly/outwardly/upwardly position for the athlete-occupant usage when engaged with transporter Main Base Frame elongated chassis frame safety wheeled apparatus device whereas the/its unattached pipe/rod ends, fit into a fitting mounted either on the Derriere embodiment for the Arms Rest or the Feet Platform embodiment for the Seat Platform and the Seat to Leg Extension Platform to rest on the Feet Platform as well, for placement and stability of said rods/parts end when inserted into said mounted fitting for its purposes, to stabilize the Arms, Seat and Legs Platform embodiments.

A ninth exemplary embodiment of the athlete-occupant transporter as in the first exemplary embodiment, wherein the athlete-occupant transporter Main Base Frame elongated frame chassis safety wheeled apparatus device has locking type pins mechanisms or the like, to keep in place the pivotal Arms, Derriere and Feet Platforms and Rest Embodiments, etc., and the rear tilting embodiment element in an upright storage/travel position when not in occupant use and said has mechanism to restrict the travel distance of said such embodiments when and for athlete-occupant when in use and or being transported from location one to location two, and the attachable/detachable Arms Platform embodiments, etc., have storage apertures where/so they can be placed on said device equipment rear rod/hooks/storage pocket(s) of the transporter, the Main Base Frame elongated chassis frame safety wheeled apparatus—the transporter, the Main Base Frame elongated chassis frame safety wheeled apparatus device and the rear leg balancing (Rear Recliner embodiment), attachable/detachable embodiment unit, is capable of being used/not used at end user's desire if and when in use or not in use.

A tenth exemplary embodiment of the athlete-occupant transporter as in the first exemplary embodiment, wherein the athlete-occupant transporter Main Base Frame chassis elongated frame safety wheeled apparatus devices-Arms, Derriere and Feet Platforms Embodiments are to be in a somewhat perpendicular position of the athlete-occupant transporter Main Base Frame chassis elongated frame safety wheeled apparatus device equipment, when in what is to be considered its appropriate proper/normal operating deployed position for the athlete-occupant to occupy.

An eleventh exemplary embodiment of the athlete-occupant transporter as in the first exemplary embodiment, wherein the Main Base Frame elongated chassis frame safety wheeled apparatus device can have multiple wheel configurations/locations as well as its multiple attachment hooks for implements attachment of known types and in known manners.

A twelfth exemplary embodiment of the athlete-occupant transporter as in the first exemplary embodiment, wherein the main chassis base elongated frame safety wheeled apparatus device has attachable/detachable embodiments.

A thirteenth exemplary embodiment of the athlete-occupant transporter as in the first exemplary embodiment, wherein the main chassis base elongated frame safety wheeled apparatus device has space for a rechargeable battery for night/dark time light/medical equipment, motorized components/embodiments (not shown) etc., use on the main chassis base elongated frame safety wheeled apparatus device and A fourteenth exemplary embodiment of the athlete-occupant transporter as in the first exemplary embodiment, wherein the main chassis base elongated frame safety wheeled apparatus device has an optional embodiment element, that provides/allows said to be reclined in desired end users positions from its understood upright allowable known sitting position.

A fifteenth exemplary embodiment of the athlete-occupant transporter as in the first exemplary embodiment, wherein the main chassis base elongated frame safety wheeled apparatus device whereas said can be and have motorized embodiments as per end user desire.

A sixteenth exemplary embodiment of the athlete-occupant transporter as in the first exemplary embodiment, wherein the main chassis base elongated frame safety wheeled apparatus device has embodiments with position locking restraint mechanism per rotatable embodiments.

A seventeenth exemplary embodiment of the athlete-occupant transporter as in the first exemplary embodiment, wherein the main chassis base elongated frame safety wheeled apparatus device that has area space for storage of embodiments/implements on/with the wheeled apparatus device its self for support embodiment elements.

An eighteenth exemplary embodiment of the athlete-occupant transporter as in the first exemplary embodiment, wherein the main chassis base elongated frame safety wheeled apparatus device reclining arm, tow bar style handle are adjustable as is the ends opposite the pivotal ends that are attachable/detachable at point where it is attachable to the chassis base elongated frame safety wheeled apparatus device, and arm/seat/feet embodiments are pivotal on its main support embodiment, that is attached to the chassis embodiments are pivotal on its main support embodiment, that is attached to the Chassis base elongated frame safety wheeled apparatus device equipment.

A nineteenth exemplary embodiment of the athlete-occupant transporter as in the first exemplary embodiment, wherein the main chassis base elongated frame safety wheeled apparatus device can have motorized/hydraulic embodiments, as well as have appropriate known type of wheels which are separate and apart from wheels shown in its base location on said main elongated frame, thus not limiting said to being only wheel(s) on said elongated safety apparatus device equipment main frame.

A twentieth exemplary embodiment of the athlete-occupant transporter as in the first exemplary embodiment, wherein the Main Body Frame Accessories Hooks (locations vary on Main Body Frame {M. B.F.}) or a known type Cable 29A for the Rear Recliner Leg(s) unit embodiment, to limit travel distance/restraint when used with hook/latch embodiment the like for said purpose(s)/(is optional) and or a type of Belt/Strap 29B, for the Rear Recliner Leg travel distance/restraint embodiment or the like for said purpose (optional) and or a type of Bar 29C for the Rear Recliner Leg travel distance/restraint embodiment or the like for said purpose (optional).

What is claimed is:

1. A multi-mode athlete transporter comprising:

an oblong chassis having two wheels at a lower end, configurable to be operable as a hand truck, said chassis when upright having an upper end, a bottom, a payload side, and a handling side opposite said payload side;

a seat hingedly attached on the payload side of the chassis at a seat height distance from the bottom, said seat foldable substantially flat to the chassis in a stowed position;

a feet platform attached on the payload side of the chassis at the bottom, said feet platform foldable substantially flat to the chassis in a stowed position;

a handle disposed at the upper end on the handling side; and an arm rest hingedly attached on the payload side of the chassis for use by an occupant seated in the seat, said arm rest foldable substantially flat to the chassis in a stowed position.

2. The multi-mode athlete transporter of claim 1 further comprising a reclining mode support member attached at the upper end and projecting away from the handling side, said support member of a length sufficient to support the transporter at a reclined angle.

3. The multi-mode athlete transporter of claim 2 wherein the reclining mode support member is attachably detachable from the chassis.

4. The multi-mode athlete transporter of claim 2 wherein the reclining mode support member further comprises a tension member attachable to a selectable attachment point on the chassis.

5. The multi-mode athlete transporter of claim 4 wherein the tension member comprises a chain or a cable.

6. The multi-mode athlete transporter of claim 2 wherein the reclining mode support member comprises configurable feet selected from the group consisting of a cup-end foot, a straight angle foot, a wheeled foot, and an angled foot.

7. The multi-mode athlete transporter of claim 1 wherein the arm rest is attachably detachable.

8. The multi-mode athlete transporter of claim 1 further comprising a medical container implement platform disposed on the handling side.

9. The multi-mode athlete transporter of claim 1 further comprising a housing unit platform for containers such as an oxygen bottle disposed on handling side.

10. The multi-mode athlete transporter of claim 1 further comprising a multiple pull/push handle system for maneuverability and control ease.

11. The multi-mode athlete transporter of claim 1 further comprising a plurality of hook apertures.

12. The multi-mode athlete transporter of claim 1 further comprising a rechargeable battery disposed on the chassis.

13. The multi-mode athlete transporter of claim 12 further comprising a motor powered by the rechargeable battery thereby motorizing the transporter.

14. The multi-mode athlete transporter of claim 12 further comprising detachable lights powered by the rechargeable battery.

15. The multi-mode athlete transporter of claim 1 further comprising a head rest disposed on the payload side.

16. The multi-mode athlete transporter of claim 15 wherein the head rest height is adjustable.

17. The multi-mode athlete transporter of claim 1 wherein the chassis consists substantially of aluminum or carbon-fiber composite.

18. The multi-mode athlete transporter of claim 1 further comprising locking elements to lock the seat, feet platform, and reclining mode support member into stowed positions.

19. The multi-mode athlete transporter of claim 1 further comprising a locking element to lock the arm rest into a stowed position.

* * * * *